US006276084B1

(12) United States Patent
Lanier

(10) Patent No.: US 6,276,084 B1
(45) Date of Patent: Aug. 21, 2001

(54) SIGN HOLDERS AND METHODS OF ASSEMBLY THEREOF

(76) Inventor: Addison Lanier, Suite 202, 1300 Richards Street, Vancouver, British Columbia (CA), V6B 3G6

( * ) Notice: Subject to any disclaimer, the term of this patent is extended or adjusted under 35 U.S.C. 154(b) by 0 days.

(21) Appl. No.: 09/387,761

(22) Filed: Sep. 1, 1999

(51) Int. Cl.[7] ..... A47G 1/06
(52) U.S. Cl. ..... 40/611; 40/738; 40/124.07
(58) Field of Search ..... 40/124.07, 650, 40/738, 745, 761, 762, 611

(56) References Cited

U.S. PATENT DOCUMENTS

| | | | | |
|---|---|---|---|---|
| 2,160,724 | * | 5/1939 | Fletcher | 40/124.07 X |
| 3,041,761 | * | 7/1962 | Knox | 40/738 |
| 3,041,762 | * | 7/1962 | Knox | 40/738 |
| 3,514,886 | * | 6/1970 | Drakard | 40/761 X |
| 3,715,823 | * | 2/1973 | Brossard | 40/738 X |
| 3,952,437 | | 4/1976 | Mitchell . | |
| 3,973,343 | * | 8/1976 | Tolfsen | 40/745 X |
| 4,149,332 | * | 4/1979 | Horwitt | 40/761 X |
| 5,619,816 | | 4/1997 | Ellison | 40/738 |

FOREIGN PATENT DOCUMENTS

| | | |
|---|---|---|
| 298 11 222 | 3/1999 | (DE) . |
| 0 707 821 | 4/1996 | (EP) . |
| 2 765 090 | 12/1998 | (FR) . |
| 8-256887 | 10/1996 | (JP) . |
| WO 95 34059 | 12/1995 | (WO) . |

* cited by examiner

*Primary Examiner*—Joanne Silbermann

(57) ABSTRACT

A sign holder has upper and lower elongate curved abutment members each with an elongate concave rear side, and backing sheet retainers extending rearwardly from the concave side at opposite ends of the concave side, the backing sheet retainers having a predetermined spacing from one another. A backing sheet has first opposite marginal edge portions facing and abutting the concave rear sides of the abutment members, the latter being rearwardly open behind the edge portions to allow the backing sheet to be displaced to and fro, and second opposite marginal edge portions retained by the backing sheet retainers. The first opposite marginal edge portions have a length greater than the predetermined spacing of the backing sheet retainers and the backing sheet is sprung into abutment against the rear sides of the abutment members with the second opposite marginal edge portions retained by the backing sheet retainers.

12 Claims, 10 Drawing Sheets

SIGN HOLDERS AND METHODS OF ASSEMBLY THEREOF

BACKGROUND OF THE INVENTION

1. Field of the invention

The present invention relates to sign holders and to methods of assembling sign holders, and is useful in particular, but not exclusively, for sign holders which are self-supporting on the ground.

2. Description of the Related Art

In U.S. Pat. No. 3,952,437, issued Apr. 27, 1976 to Robert W. Mitchell, there is disclosed a display frame for photographs or other displays which enables pictures to be displayed in a curved position. More particularly, the aforesaid patent discloses a display frame comprising spaced upper and lower plates having shaped edges formed with curved slots for receiving the picture and a backing sheet. Spacers are provided between the plates, and the plates are drawn towards one another by means of a rubber band or the like.

It is, however, a disadvantage of this prior display frame that the assembly of the frame is complicated, since the picture must somehow be inserted into the slots of the upper and lower plates, apparently while the latter are being drawn together by the rubber band or the like and while the spacers are also being fitted to the vertical edges of the picture.

BRIEF SUMMARY OF THE INVENTION

According to the present invention, there is provided a sign holder which has upper and lower elongate curved abutment members, each having an elongate curved rear side, with backing sheet retainers extending rearwardly from the concave side at opposite ends of the concave side, the backing sheet retainers having a predetermined spacing from one another. A backing sheet has first opposite marginal edge portions facing and abutting the concave rear sides of the abutment members, the latter being rearwardly open behind the first opposite marginal edge portions, and second opposite marginal edge portions retained by the backing sheet retainers. The first edge portions each have a length greater than the predetermined spacing of the backing sheet retainers.

In use, the second marginal edge portions of the backing sheet are inserted between the backing sheet retainers and the concave rear sides of the abutment members, with the backing sheet concavely curved at its side facing the abutment members and spaced from the concave rear sides of the abutment members. The backing sheet is then pressed towards the abutment members, to thereby spring the backing sheet into engagement into the backing sheet retainers and into abutment against the concave rear sides of the abutment members. The backing sheet then serves as a spacer for the abutment members.

The assembly and disassembly of the present sign holder are thus effected by simply pressing the backing sheet towards or away from the concave rear sides of the abutment members, so that the present sign holder can be easily and quickly assembled at the location at which it is to be used.

BRIEF SUMMARY OF THE INVENTION

The present invention will be more readily understood from the following description of a preferred embodiment thereof given, by way of example, with reference to the accompanying drawings, in which.

DESCRIPTION OF THE PREFERRED EMBODIMENT

Figure 1:
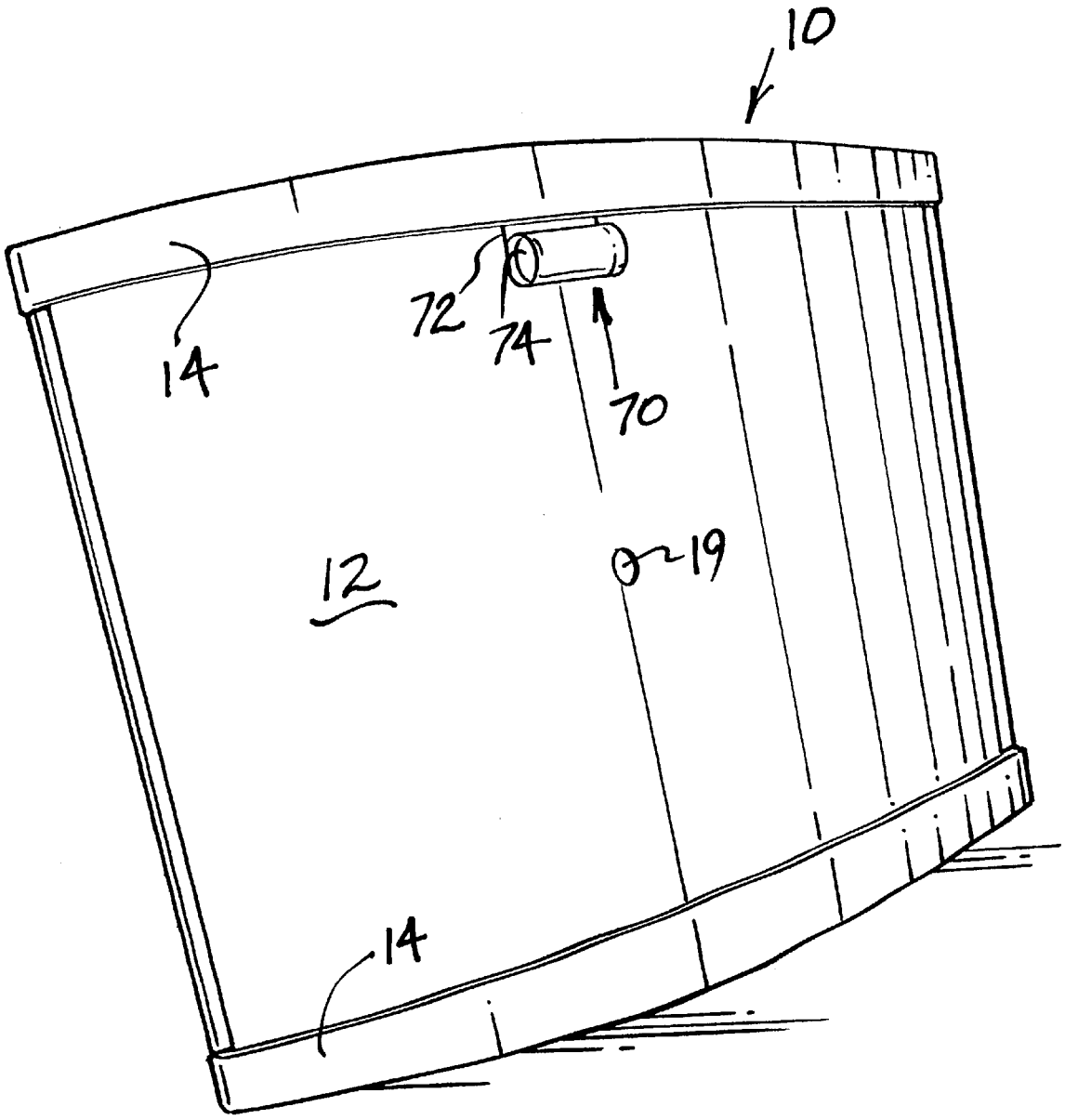
FIG. 1 shows a view in perspective of a sign holder embodying the present invention, from the front of the sign holder.

In FIGS. 1 through 10 of the accompanying drawings, there is illustrated a sign holder according to a first embodiment of the present invention, which is indicated generally by reference numeral 10, and which comprises a backing sheet 12 assembled with identical upper and lower elongate curved abutment members 14. The abutment members 14 each have a concave rear side 16, at opposite ends of which backing sheet retainers 18 extend rearwardly from the concave rear side 16. The backing sheet retainers 18 have a predetermined spacing S (FIG. 4A) from one another and the backing sheet 12 has a central circular finger-hole 19 to facilitate carrying of the sign holder 10.

The backing sheet 12 has first opposite marginal edge portions 20 facing and abutting the concave rear sides 16 of the abutment members 14 and second opposite marginal edge portions 22 retained by the backing sheet retainers 18.

Figure 3:
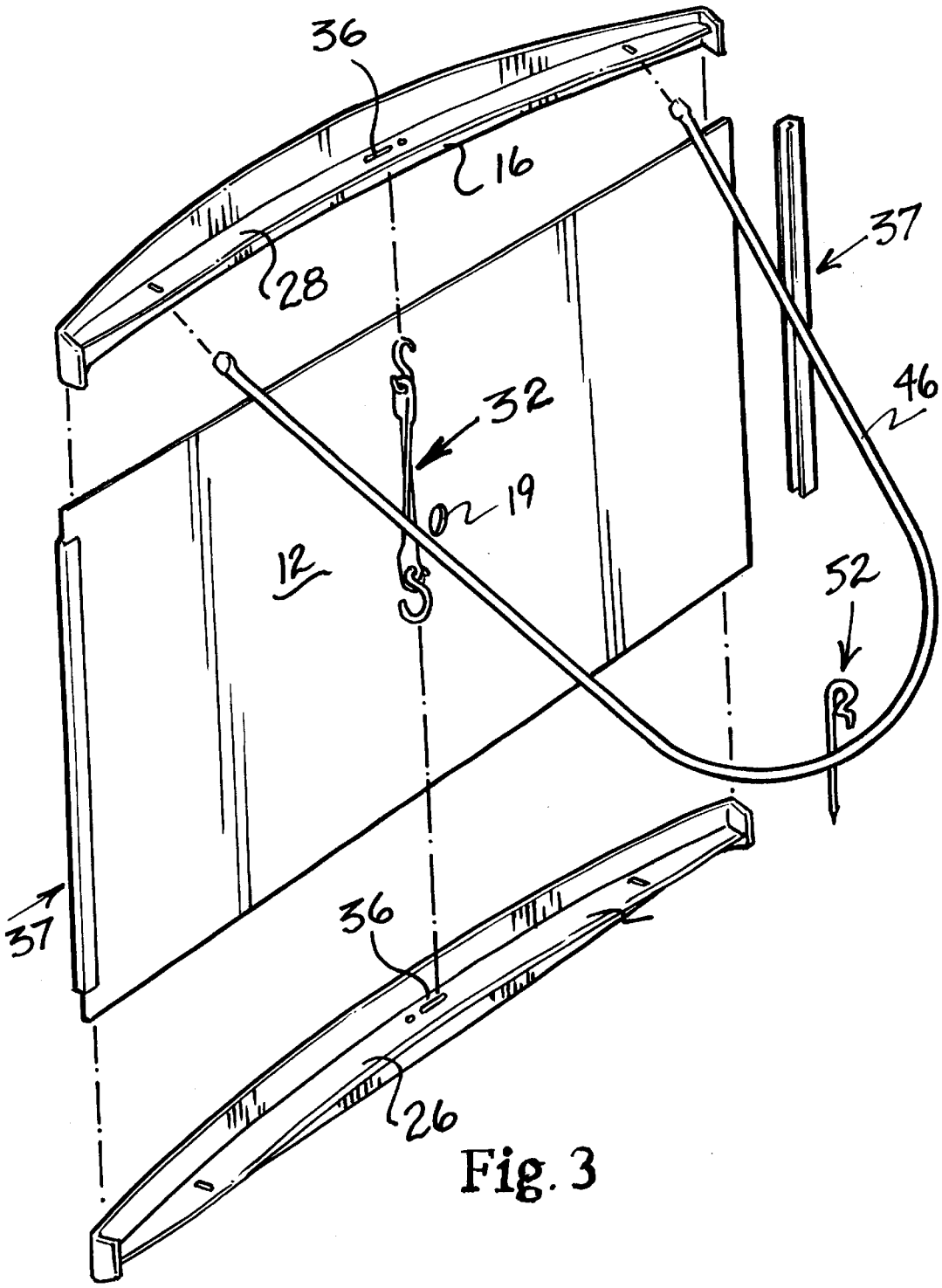
FIG. 3 shows a view similar to FIG. 2 but with the components of the sign holder separated from one another.
Figure 4A:
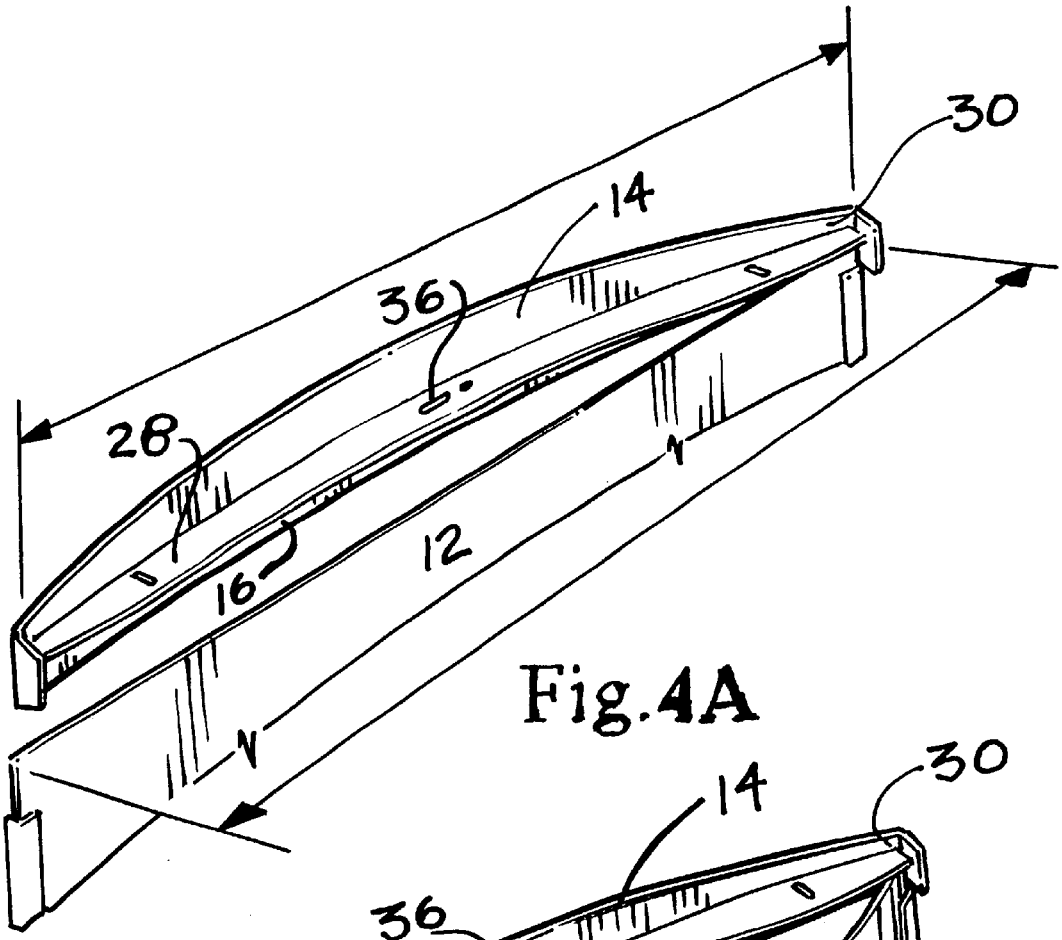
FIGS. 4A, 4B and 4C show successive steps in the assembly of the sign holder of FIG. 1.
Figure 4B:
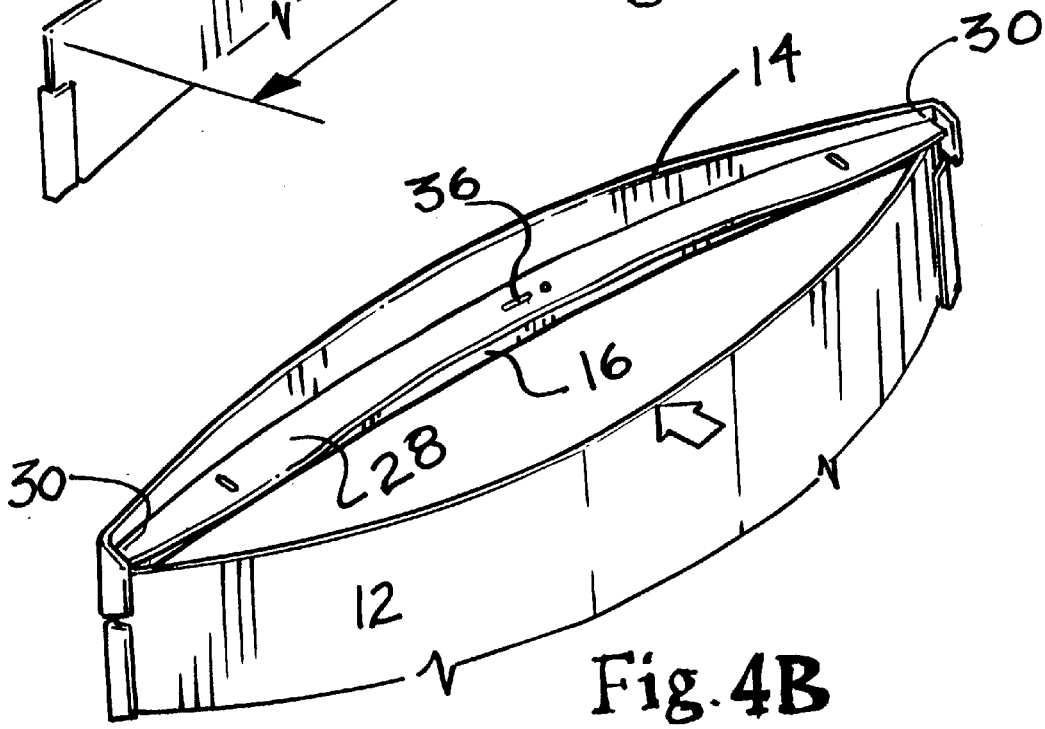

The first opposite marginal edge portions 20 each have a length L (FIG. 4A) greater than the predetermined spacing S of the backing sheet retainers 18 as shown in FIGS. 3, 4A and 4B.

Figure 2:
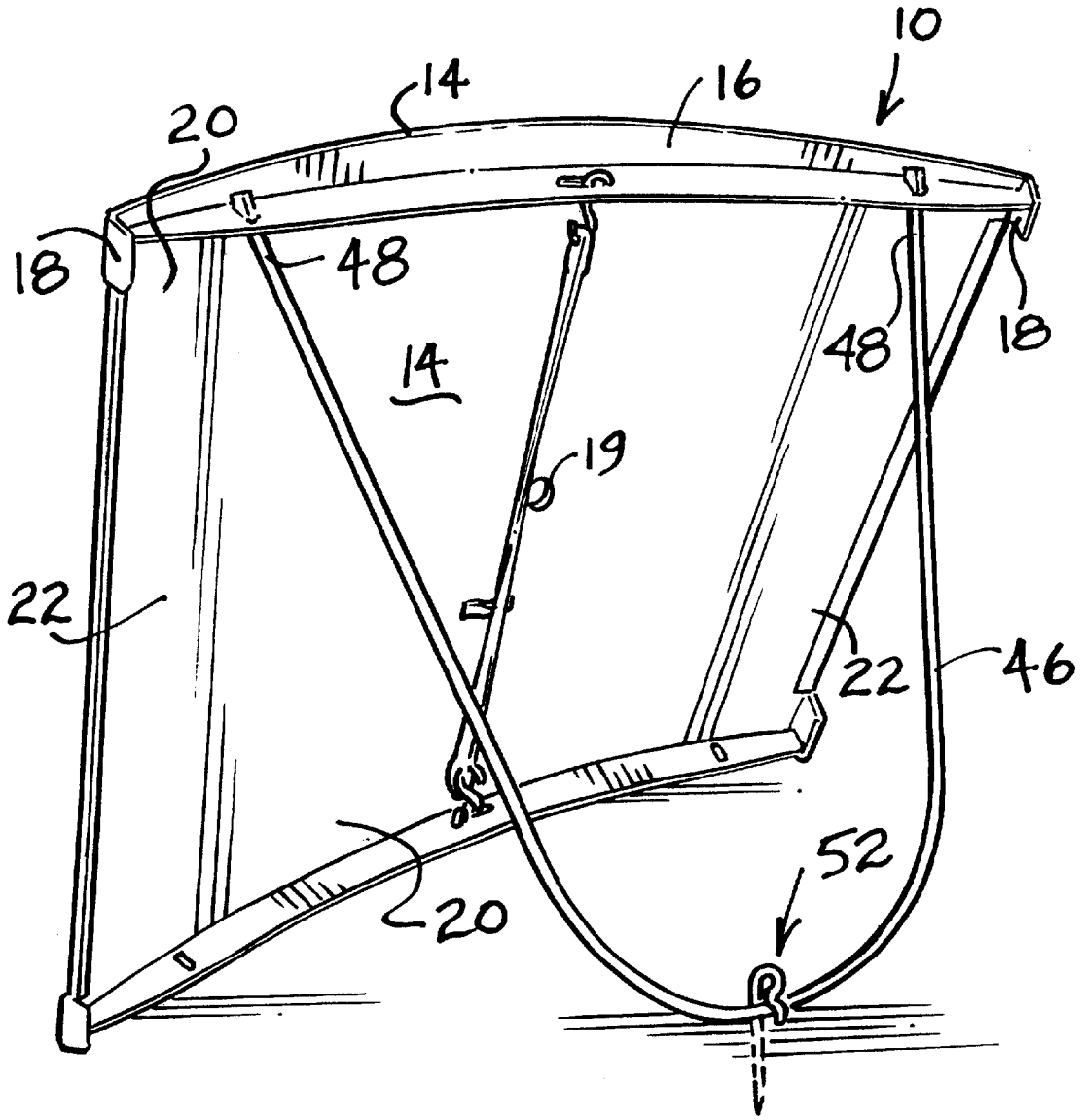
FIG. 2 shows a view in perspective of the sign holder of FIG. 1, but taken from the rear of the sign holder.

Therefore, when the backing sheet 12 is assembled with the abutment members 14, one of the edge portions 22 is inserted into one of the backing sheet retainers 18 of the upper abutment member 14, as shown in FIG. 4A, and also into the corresponding backing sheet retainer 18 of the lower abutment member 14. The opposite edge portion 22 of the backing sheet 12 is then inserted into this retainer 18 at the opposite ends of the abutment members 14. This causes the backing sheet 12 to assume a curved shape, with the front side of the backing sheet 12 being convex towards the convex rear sides 16 of the abutment members 14. By pressing against the rear side of the backing sheet 12, the backing sheet 12 is sprung into the position, relative to the abutment members 14, in which it is shown in FIGS. 1 and 2 and in which the front face of the backing sheet 12 is convex and adjacent the concave rear sides 16 of the abutment members 14. By pressure of the edge portions 22 of the backing sheet 12 against the backing sheet retainers 18, the two abutment members 14 and the backing sheet 12 are thereby retained or locked together as an assembly, which can, for example, be lifted, without falling apart, by gripping the upper abutment member.

Figure 4C:
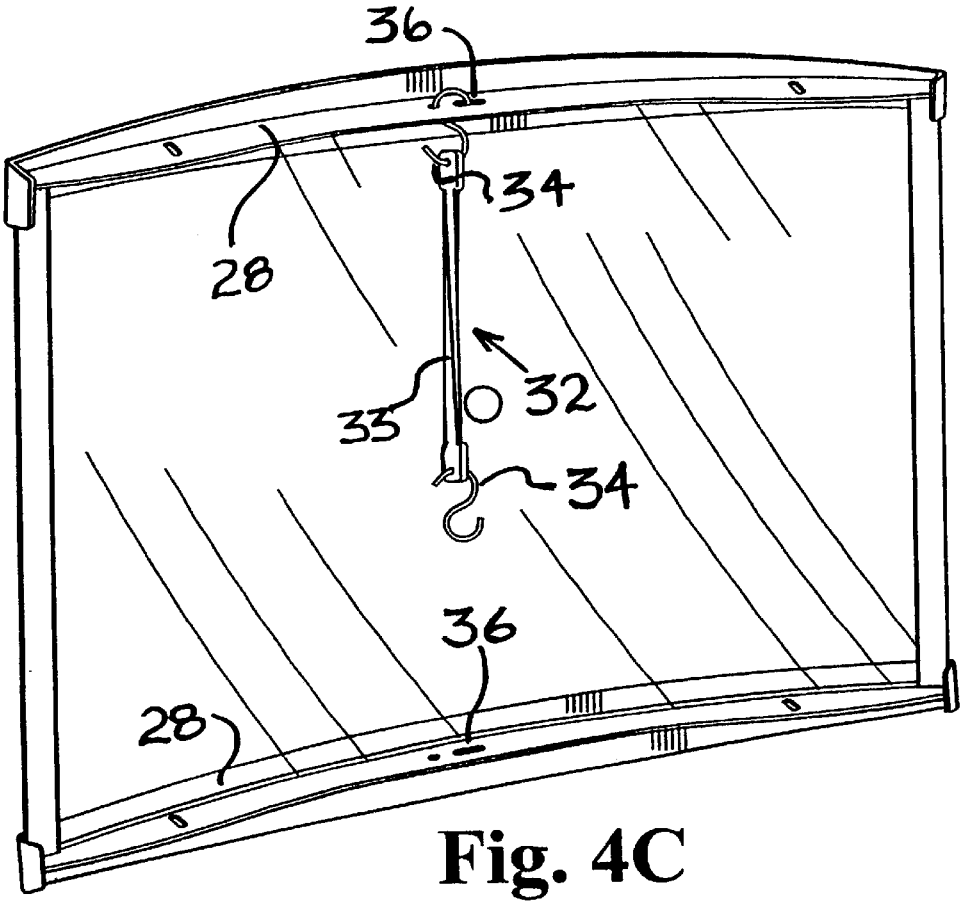

A resilient retainer, indicated generally by reference numeral 32 and shown partly attached to this assembly in FIG. 4C, is then provided as described in greater detail below.

Figure 7:
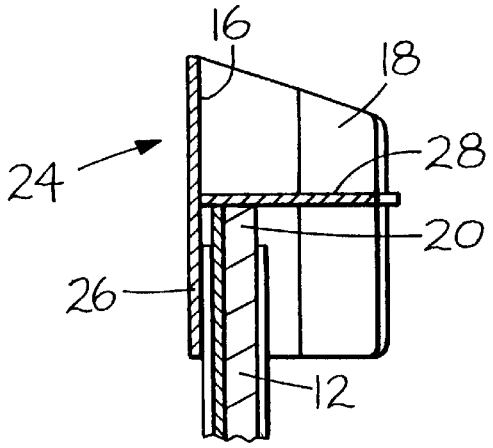
FIG. 7 shows a view taken in cross-section along the line 7—7 of FIG. 6.

The abutment members 14 have a T-shaped cross-section, as shown in FIG. 7, formed by an elongate curved front plate indicated generally by reference numeral 24 having a convex front side 26, and a flat flange or plate 28 projects rearwardly from the concave rear side 16. The marginal edge portions 20 of the backing sheet 12 abut the flat flanges 28 of the abutment members 14, so that the backing sheet 12 is accommodated between and retained by the flat flanges 28. The flat flanges 28 thus form abutments extending rearwardly of the abutment members 14 past the first opposite marginal edge portions 20 of the backing sheet 12. The abutment members 14 are rearwardly open and unobstructed behind the first opposite marginal edge portions 20 so as to allow the backing sheet 12, and in particular the first opposite marginal edge portions 20, to be displaced to and fro perpendicular to the concave rear side during assembly and disassembly of the sign holder.

The backing sheet retainers 18 comprise end portions of the front plate 24, which are bent to form flanges extending rearwardly from the concave rear sides 16 and, thereby, forming with the concave rear sides 16 of the abutment members 14 pairs of opposed concave recesses 30 at opposite ends of the rear side 16. These opposite concave recesses 30 receive and engage the second opposite marginal edge portions 22 of the backing sheet 12.

The elongate resilient retainer 32 is stretched between the abutment members 14 and comprises a loop 33 of resilient elastomeric material engaged with a pair of S-shaped hooks 34, which are engaged through slots 36 in the flat flanges 28 of the two abutment members 14 for more securely holding together the backing sheet 12 and the abutment members 14.

The backing sheet 12 is provided with elongate edge covers or clips, indicated generally by reference numerals 37, which are plastic extrusions and which each extend along and are engaged over the second opposite marginal edge portions 22 of the backing sheet 12 with opposite ends of the covers 37 extending between the backing sheet 12 and the abutment members 14.

Figure 5:
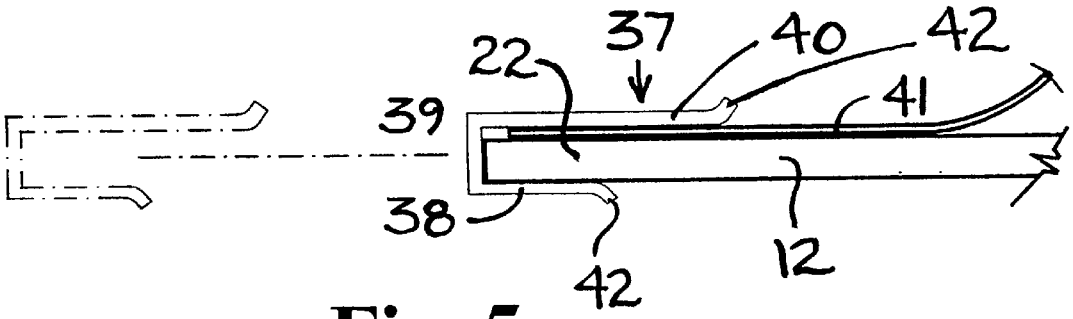
FIG. 5 shows a broken-away view of one marginal edge portion of a backing sheet forming part of the sign holder of FIG. 1.
Figure 6:
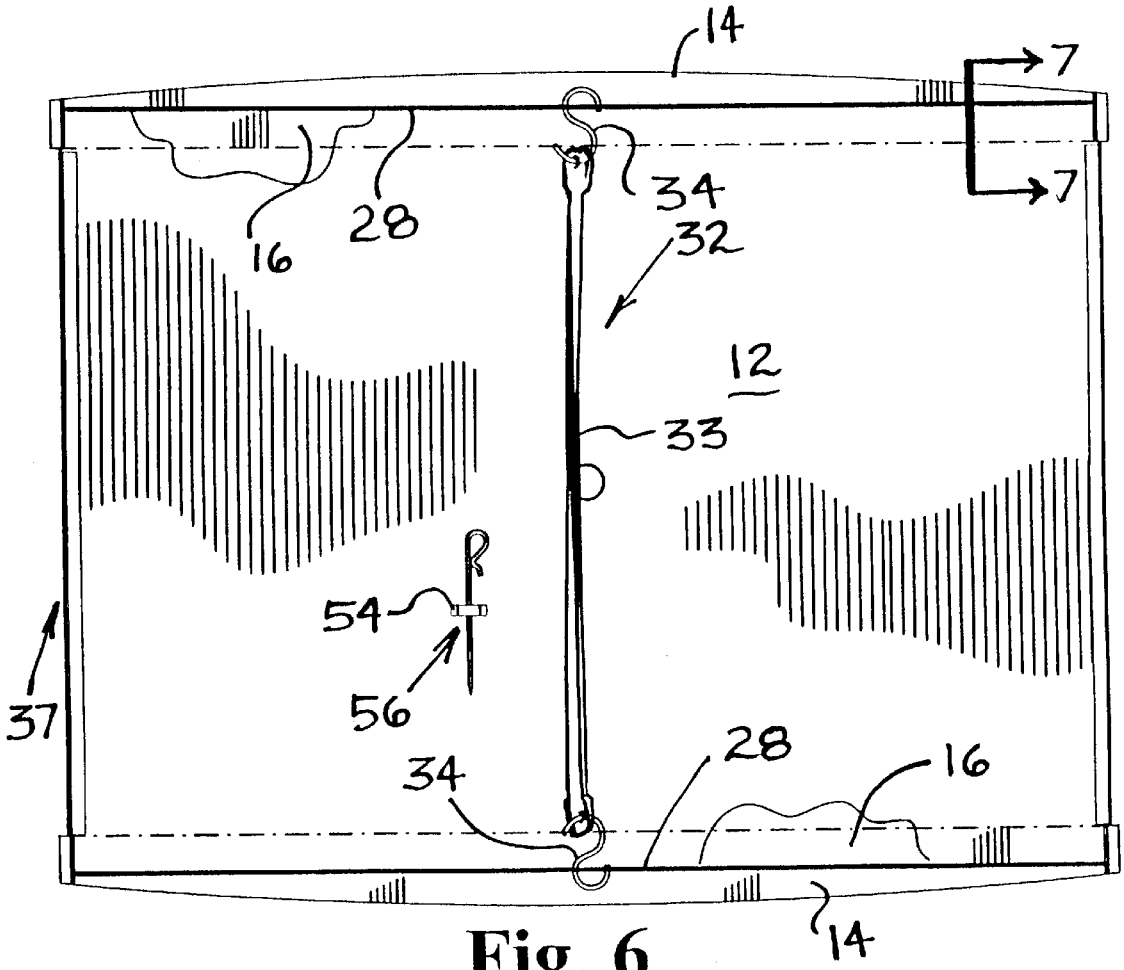
FIG. 6 shows a view in rear elevation of the sign holder of FIG. 1.

As shown in FIG. 5, in the present embodiment of the invention each of these edge covers 37 comprises an edge portion or flange 38 at the rear of the backing sheet 12, an intermediate portion 39 and a further edge portion or flange 40, which is connected by the intermediate portion 39 to the edge portion 38 and which extends onto and retains a display sheet 41 at the front of the backing sheet 12. The edge portions 38 and 40 have curved outturned edges 42 to enable the edge covers 37 to be slid onto the edges of the backing sheet 12 and the display sheet 41 by resiliently spreading apart the edge portions 38 and 40.

The assembly of the backing sheet 12 and the two abutment members 14, with the edge covers 37, and the resilient retainer 32, can be supported at an inclination on the ground, as shown in FIG. 2, by means of a U-shaped support rod 46 having ends 48 engageable in slots 50 in the flat flanges 28 of one of the abutment members 14. The lower edge of the lowermost abutment member 14 is curved so as to lie flush with the ground.

Figure 8A:
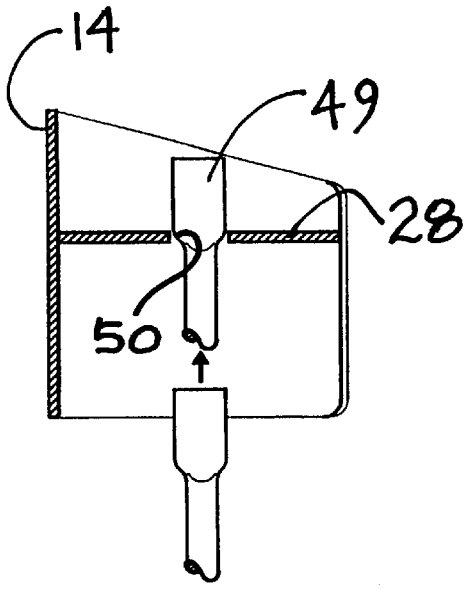
FIGS. 8A and 8B show views taken in cross-section through part of a sign holder of FIG. 1 during and after, respectively, the engagement of a support rod.
Figure 8B:
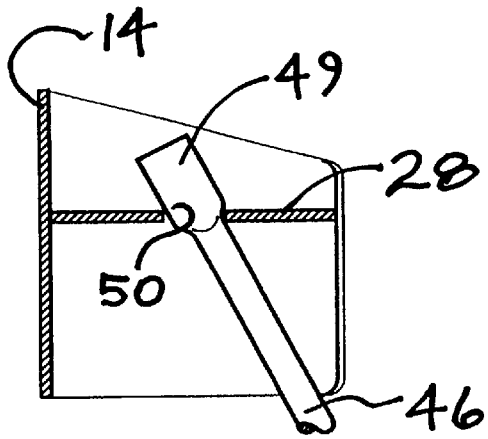

The support rod 48 has, at each end, a flattened end portion 49 which, as shown in FIGS. 8A and 8B, is inserted in the direction of arrow A in FIG. 8A through a respective one of a pair of slots in the flange 28 of the uppermost abutment member 14, of which one slot is shown in FIGS. 8A and 8B and is indicated by reference numeral 50. The rod 46 is then pivoted in the direction of arrow A to engage the flattened end portion 49 with the edges of the slot 50 as shown in FIG. 8B. Also, the ends 48 odf the rod 46 have to be pressed together to enable them to be inserted into the slots in the flange 28 so that when released, the ends press resiliently against the edges of the slots.

Figure 9:
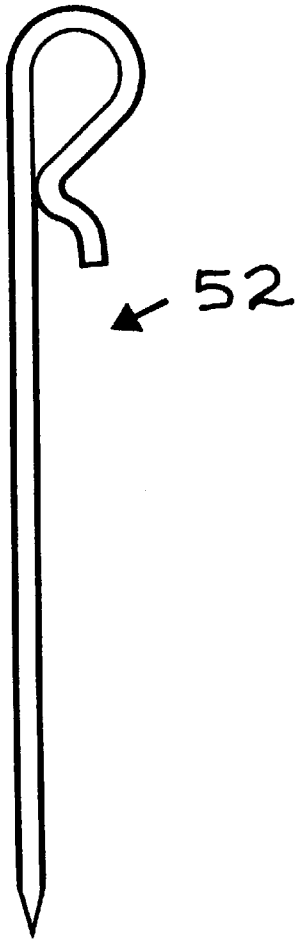
FIG. 9 shows a view in side elevation of a retainer peg forming part of the sign holder of FIG. 1.

The support rod 46 may, if required, be pegged to the ground by means of a retainer peg which is indicated generally by reference numeral 52 in FIG. 2 and shown in greater detail in FIG. 9, and which, when not in use, is secured to the back of the backing sheet 12 by means of a retainer strip 54 (FIG. 6) adhered to the backing sheet 12.

Referring again to FIG. 1, the sign holder 10 is provided with a cylindrical tube indicated generally by reference numeral 70 for holding business cards (not shown) when the sign holder is used e.g. for realtors' signage. The tube 70 has flap 72 tucked between the upper abutment member 14 and the backing sheet 12 for retaining the tube 70 in position, and a removable end cap 74.

Figure 10:
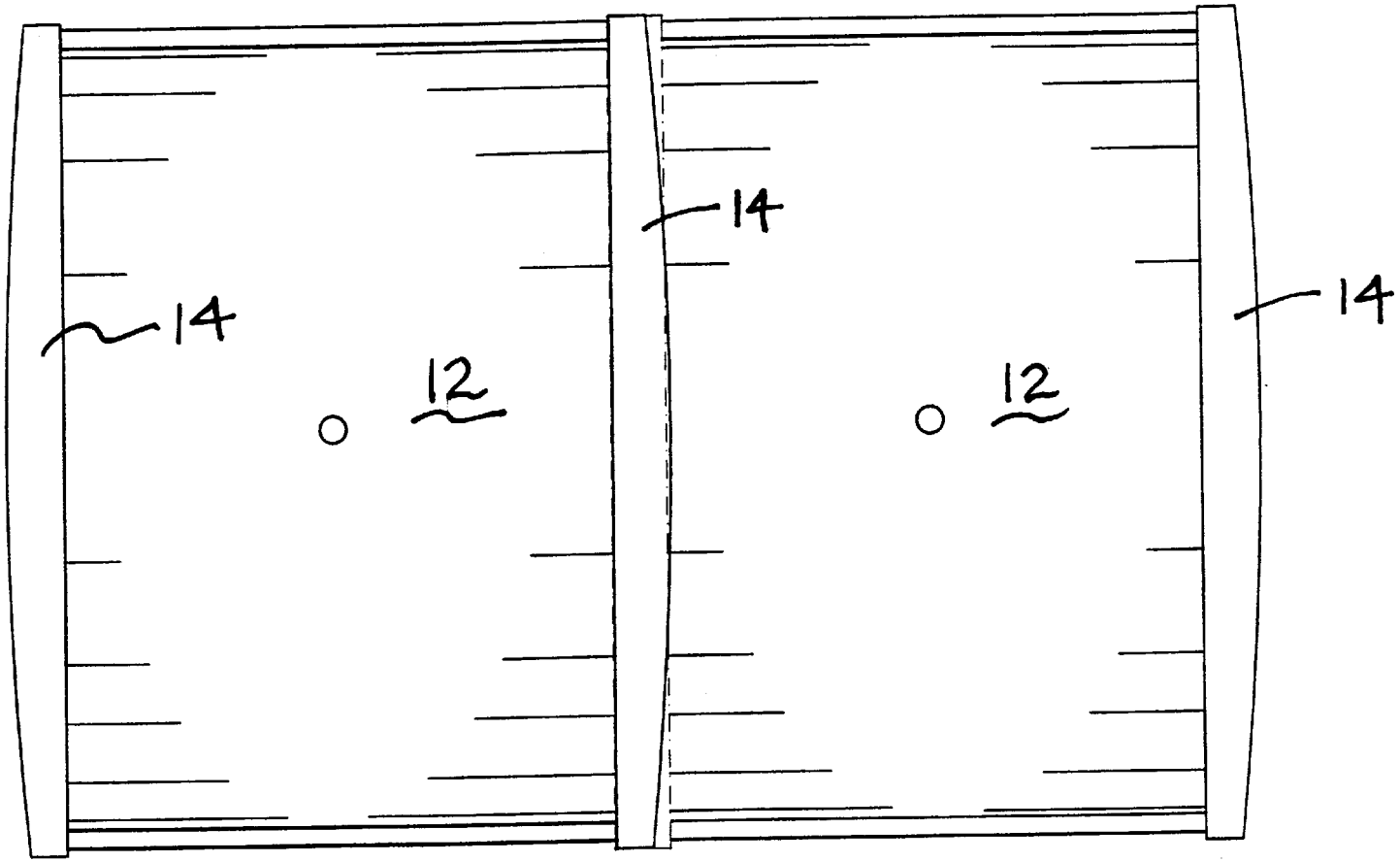
FIG. 10 shows a view in front elevation of an extended version of the sign holder of FIGS. 1 through 7.

As shown in FIGS. 1 through 7, the sign holder 10 comprises only two abutment members 14 and one backing sheet 12. However, as shown in FIG. 10, a second backing sheet 12 and a third abutment member 14 may be added, together with a further resilient retainer 32 (not shown), in order to extend the sign holder 10 and, thereby to present an enlarged display.

Also, instead of mounting the sign holder 10 on the ground with the abutment members 14 extending horizontally as shown in FIGS. 1 and 2, the support rod 46 may be removed and the sign holder 10 may then be rotated through 90 degrees so that the abutment members 14 extend vertically. The backing sheet retainers 18 at the upper ends of the two abutment members 14 may then be employed as hooks for engagement over a suitable ledge or other support (not shown) so as to suspend the sign holder, e.g. from a wall.

Figure 11:
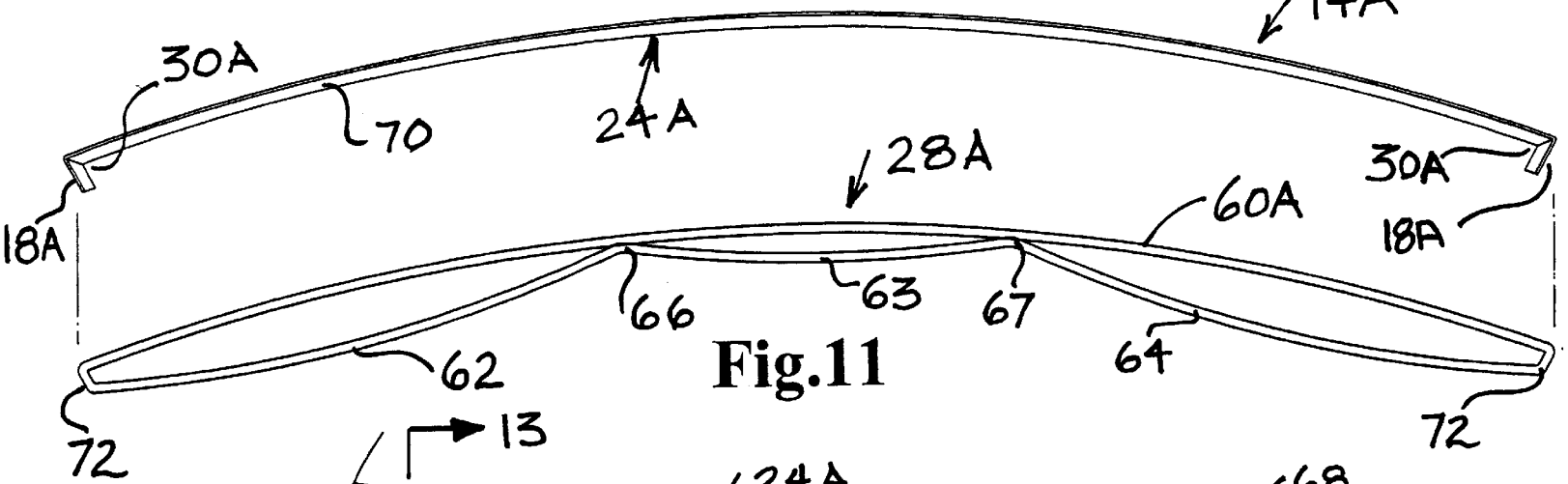
FIG. 11 shows a view in rear elevation of an abutment member forming part of a sign holder according to a second embodiment of the invention.
Figure 13:
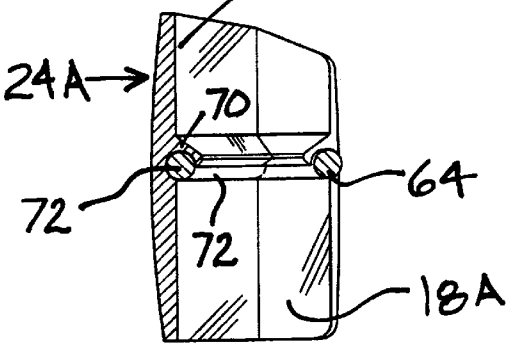
FIG. 13 shows a broken-away view in rear elevation of parts of the abutment member of FIG. 11 with an asociated component of the sign holder.
Figure 12:
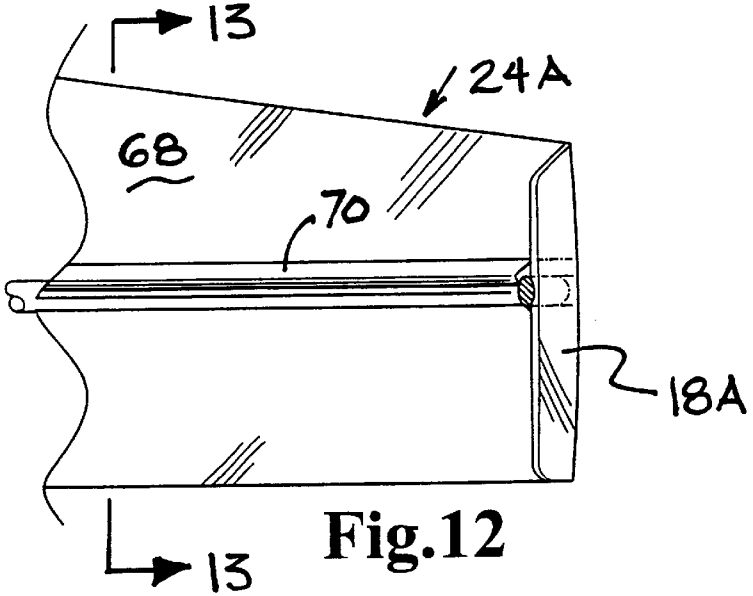
FIG. 12 shows a plan view of the abutment member of FIG. 11.

In FIGS. 11 through 13 of the drawings, there is illustrated a modified abutment member, indicated generally by reference numeral 14A. In a second embodiment of the invention, a pair of the abutment members 14A replace the abutment members 14 of FIG. 1.

The abutment member 14A of FIGS. 11 through 15 comprises two components, namely an elongate front plate indicated generally by reference numeral 24A, which corresponds to the front plate 24 of the embodiment of FIGS. 1 to 10, and a backing sheet abutment indicated generally by reference numeral 28A, which corresponds to the abutment flange 28.

The backing sheet abutment 28A is formed of a length of metal wire which is bent to form curved front portion 60 and three curved rear portions 62,63 and 64, which are welded to the front portion 60 at locations 66 and 67 and which serve to reinforce the front portion 60.

The front plate 24A has a concave rear side 68 formed with a rib 70 extending the length of the front plate 24A, and the rib 70 is formed with a rearwardly open recess 72 of circular cross-section for receiving and engaging the curved front portion 60 of the backing sheet abutment 28A.

Opposite end portions of the front plate 24A are bent back to form a pair of backing sheet retainers 18A, corresponding to the backing sheet retainers 18 of the first embodiment and the backing sheet retainers 18A likewise form flanges extending rearwardly from the rear side 68 and forming therewith opposed concave recesses 30A for receiving and engaging the second opposite marginal edge portions 22 of the backing sheet 12. The ribs 70 extend across the backing sheet retainers 18A and receive and engage opposite ends 72 of the backing sheet abutment 24A.

Figure 15B:
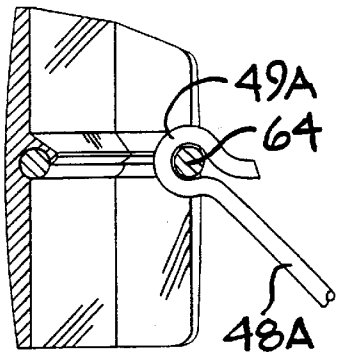
FIGS. 14 and 15 show, respectively, views taken in cross-section along the line 15—15 of FIG. 13 with the component omitted and included..
Figure 15A:
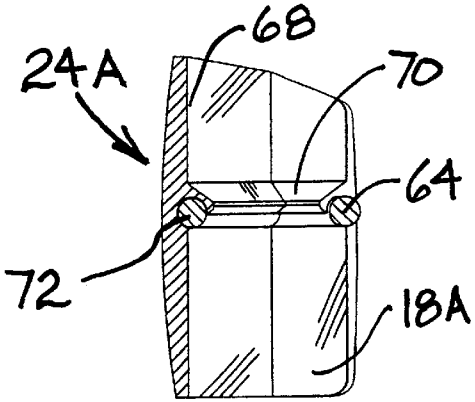
Figure 14:
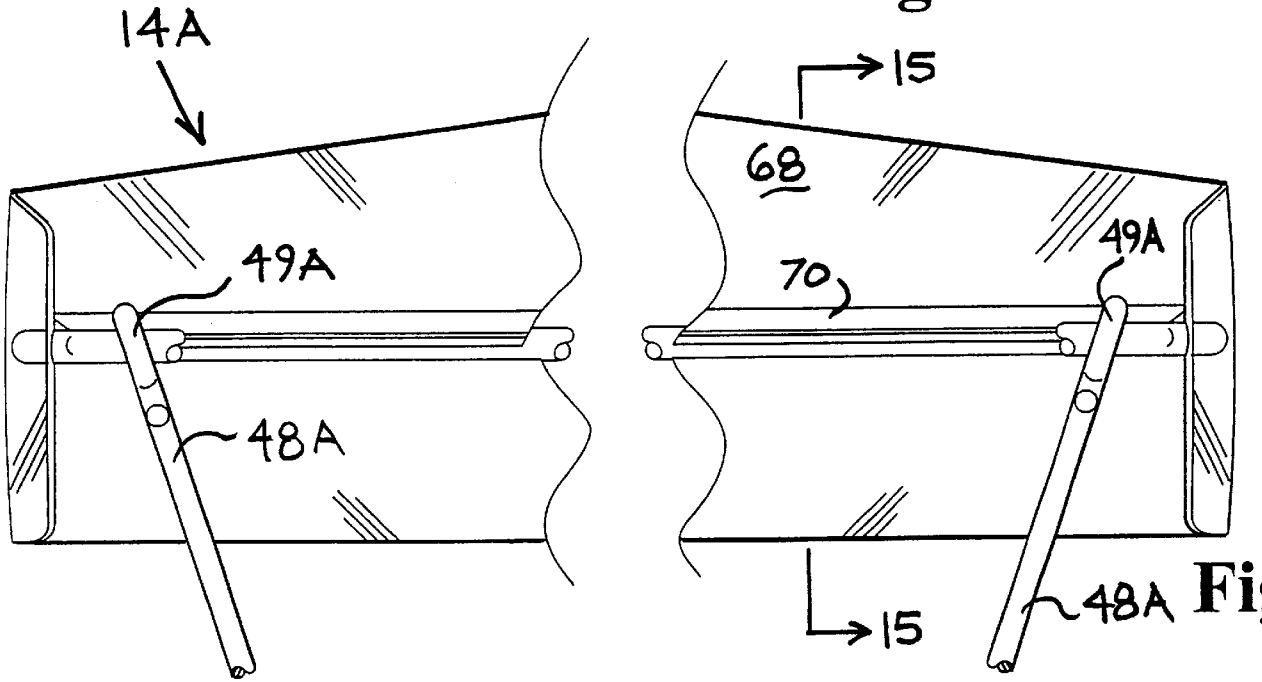

A support rod 48A is releasably secured to the curved portions 62 and 64 of the backing sheet abutment 48A and is similar to the support rod 48 of the first embodiment, except that instead of the flattened end portions 49 of the support rod 48, the support rod 48A is formed with bent end portions 49A which are shaped to engage with the wire of the curved portions 62 and 64 as illustrated in FIG. 15.

The remaining components of the second embodiment of the sign holder according to the present invention are similar to the corresponding components of FIGS. 1 through 10 and are therefore not further described or illustrated.

The backing sheet retainers 18 of the first embodiment are made of stainless steel but other suitable materials, e.g. plastic material, which may be translucent or even transparent, may alternatively be employed.

The backing sheet retainers 18A of the second embodiment are formed of plastic extrusions, which may likewise be translucent or transparent.

Also, the upper and lower edges of the front plates 24 and 24A may be curved, or may alternatively be straight and parallel.

If desired, the resilient retainer 32 may be omitted from the two above-described embodiments of the invention.

As will be appreciated by those skilled in the art, various other modifications may be made in the above-described embodiment of the invention within the scope of the appended claims.

I claim:

1. A sign holder, comprising:

upper and lower elongate curved abutment members;

said abutment members each having an elongate concave rear side;

backing sheet retainers extending rearwardly from said concave rear side at opposite ends of said concave rear side, said backing sheet retainers having a predetermined spacing from one another; and a backing sheet;

said backing sheet having first opposite marginal edge portions facing and abutting said concave rear sides of said abutment members and second opposite marginal edge portions retained by said backing sheet retainers;

said first opposite marginal edge portions each having a length greater than said predetermined spacing of said backing sheet retainers and said backing sheet being sprung into abutment against said rear sides of said abutment members with said second opposite marginal edge portions retained by said backing sheet retainers; and said abutment members being rearwardly open behind said first opposite marginal edge portions of said backing sheet so as to allow said backing sheet to be displaced to and fro perpendicular to said concave rear side.

2. A sign holder as claimed in claim 1, wherein said backing sheet retainers each comprise flanges on said abutment members, said flanges forming, with said concave rear side of said member, pairs of opposed concave recesses at the opposite ends of said rear sides and said opposed concave recesses receiving said second opposite marginal edge portions of said backing sheet.

3. A sign holder as claimed in claim 1, wherein said abutment members have backing sheet retainer abutments extending rearwardly from said abutment members past said first opposite marginal edge portions of said backing sheet.

4. A sign holder as claimed in claim 1, wherein said abutment members each have a T-shaped cross-section, said T-shaped cross-section being formed by a curved flange, said concave side forming a concave rear face on said curved flange, and a flat flange projecting rearwardly from said concave rear face, said first opposite marginal portions of said backing sheet being accommodated between and retained by said flat flanges.

5. A sign holder as claimed in claim 4, wherein said backing sheet retainers each comprise a flange on the respective one of said abutment members, said flanges forming with said rear side of said member a pair of opposed concave recesses at the opposite ends of said rear side and said opposed concave recesses receiving said second opposite marginal edge portions of said backing sheet.

6. A sign holder as claimed in claim 1, further comprising an elongate resilient retainer stretched between said abutment members, said resilient retainer having opposite ends in releasible engagement with said abutment members.

7. A sign holder as claimed in claim 1, further comprising elongate edge covers each extending along and engaged over said second opposite marginal edge portions of said backing sheet from one to the other of said abutment members.

8. A sign holder as claimed in claim 1, further comprising a curved support rod, said abutment members and opposite ends of said support rod having mutually releasibly engageable portions.

9. A sign holder as claimed in claim 1, wherein said abutment members each comprises a curved front plate and a backing sheet abutment formed separately from said front plate.

10. A sign holder as claimed in claim 9, wherein said abutment members are provided, at rear sides thereof, with formations shaped to engage and retain said backing sheet abutments.

11. A sign holder as claimed in claim 9, wherein said front plates each have a curved rear side, a rib extending along said rear side and a rearwardly open recess in said rib, and said backing sheet abutments are engaged in said recesses.

12. A sign holder as claimed in claim 11, wherein said backing sheet abutments each comprise a length of wire and a portion of said wire is engaged in a respective one of said recesses.

* * * * *